US007926682B2

(12) United States Patent
Nelson et al.

(10) Patent No.: US 7,926,682 B2
(45) Date of Patent: Apr. 19, 2011

(54) APPARATUS FOR RECONSTITUTING AND APPLYING LIQUIDS AND METHOD OF USING SAME

(76) Inventors: Steven D. Nelson, Buena Park, CA (US); Leona I. Nelson, Buena Park, CA (US)

( * ) Notice: Subject to any disclaimer, the term of this patent is extended or adjusted under 35 U.S.C. 154(b) by 1033 days.

(21) Appl. No.: 11/788,536

(22) Filed: Apr. 20, 2007

(65) Prior Publication Data

US 2008/0073375 A1 Mar. 27, 2008

Related U.S. Application Data

(60) Provisional application No. 60/845,838, filed on Sep. 19, 2006, provisional application No. 60/855,702, filed on Oct. 30, 2006, provisional application No. 60/855,722, filed on Oct. 30, 2006.

(51) Int. Cl.
*B67D 7/74* (2010.01)

(52) U.S. Cl. ..... 222/130; 222/129; 222/143; 222/158; 222/325; 222/83.5; 222/82; 215/10; 141/330; 239/303; 239/309; 239/352; 220/23.4; 220/23.83

(58) Field of Classification Search ..... 222/81–83.5, 222/88, 129, 130, 158, 325, 143, 192; 215/10; 239/303, 304, 307–309, 352; 141/18, 329, 141/330, 364–366, 375; 220/23.4, 23.6, 220/23.8, 23.83, 23.86
See application file for complete search history.

(56) References Cited

U.S. PATENT DOCUMENTS

| | | | | |
|---|---|---|---|---|
| 3,181,737 | A * | 5/1965 | Chaucer | 222/136 |
| 4,355,739 | A | 10/1982 | Vierkotter | |
| 4,779,722 | A | 10/1988 | Hall | |
| 4,925,066 | A | 5/1990 | Rosenbaum | |
| 5,085,330 | A | 2/1992 | Paulin | |
| 5,375,742 | A * | 12/1994 | Mowry | 222/131 |
| 5,647,481 | A | 7/1997 | Hundertmark et al. | |
| 5,836,479 | A | 11/1998 | Klima et al. | |
| 5,964,377 | A | 10/1999 | Demarest et al. | |
| 6,036,057 | A | 3/2000 | Poutiatine | |
| 6,851,580 | B2 * | 2/2005 | Stank et al. | 222/129 |
| 6,971,549 | B2 | 12/2005 | Leifheit et al. | |
| 2004/0238566 | A1 | 12/2004 | Stank et al. | |
| 2007/0017890 | A1 | 1/2007 | Al-Jadh | |

OTHER PUBLICATIONS

Webpage, http:///gallery.bcentral.com/GID4703820DD115811-CHEMICALS/DILUTION+SYSTEMS, Janimart For A Clean Start Use Janimart, 3M Twist N'Fill, Jan. 3, 2007, 2 pages, Janimart Corporation, East Hanover, NJ.

Webpage, http://products3.3m.com/catalog/us/en001/manufacturing_industry/commercial_care/node, 3M United States, 3M Twist 'n Fill Cleaning Chemical Dispenser and Accessories, Jan. 3, 2007, 2 pages, © 3M 1995-2006.

Flyer, Advanced Dispensing Systems, LLC, Thinking Outside The Bottle, Introducing The Evolution Sports Bottle Taking The Product On The Go, 1 pg., © 2007 Advanced Dispensing Systems, LLC.

Webpage, http://everich.en.aliababa.com/product/50016242/50087181/PC_Bottles/Durable_Sports_PC, Hangzhou Everich Houseware Co., Ltd., Durable Sports PC Water Bottles with CUP, 3 pages, © 1999-2007 Alibaba.com Corporation.

* cited by examiner

*Primary Examiner* — J. Casimer Jacyna

(74) *Attorney, Agent, or Firm* — Fulwider Patton LLP

(57) ABSTRACT

Combined applicator container and concentrate cartridge with the container including a holder for releasably holding the cartridge thereon and a transfer device interposed between the container and cartridge for transferring selected quantities of concentrate from the cartridge to the container.

7 Claims, 12 Drawing Sheets

6
6
105
111
101
103
107
109
77
99
98
75
95
5
127
147
119
71
142
121
145
130
117
151
67
125
142
141
69
137
143
171
159
177
167
155
70
157
129
140
163
139
65
133
5

APPARATUS FOR RECONSTITUTING AND APPLYING LIQUIDS AND METHOD OF USING SAME

CROSS-REFERENCES TO RELATED APPLICATIONS

This is a non-provisional application claiming priority to provisional application number 60/845,838, entitled Advanced Chemical Management System, filed on Sep. 19, 2006, provisional application number 60,855,702, entitled Advanced 12 Chemical Management and Dispensing System filed on Oct. 30, 2006, and provisional application No. 60,855,722, entitled 12 in 1 Advanced Chemical Management and Dispensing System filed on Oct. 30, 2006 which are hereby incorporated by reference in its entirety.

BACKGROUND OF THE INVENTION

1. Field of the Invention

The present invention relates to a device for containing, storing and combining concentrate with a dilutant such as water.

2. Description of the Prior Art

Each day tens of thousands of disposable applicator bottles are employed in home and industrial use for disinfectant, cleaning and the like. These applicator bottles typically incorporate sprays or squeeze release and are often to be employed for a single fill resulting in discard after consumption of a relatively small volume of mixed liquid, for instance on the order of 28 ounces. The process of filling, storage and shipping such containers is extremely labor intensive and expensive. As an example, disinfectants and cleaners are often premixed on an assembly line to fill bottles and package cartons of 36 or so to be carted to storage or shipped thus generating liquid of substantial bulk and weight. This can result in subjecting workers handling same to fatigue and injury from lifting and manipulating the heavy cartons about for transport and storage.

For single use bottles disposal can present a challenge and contributes significantly to the filling of landfills with plastics that resist degrading and decomposition. In some applications, as for instance, commercial and industrial settings, efforts have been made to reuse spray bottles and the like by refilling them with a mix of, for instance, disinfectant and water. Often times it is necessary to dedicate an employee to simply refilling the spray bottles with cleaning and disinfecting agents to ready the reconstituted liquid to perform its work. While helpful in reducing the magnitude of discarded bottles, these procedures may require that each day empty and partially empty bottles be collected at a central location for refilling. The refilled bottles must then be distributed to work sites thus taking a toll on the efficient operation of an institution. In some instances, the disinfecting agent may be toxic or harmful to the skin or eyes thus adding to the risk and inconvenience of refilling through a conventional bottle neck.

In some industrial settings, the bottles are used at various different locations such as dishwashing or laundry stations, food dispensing stations, paint or epoxy mixing stations and at a myriad of other stations. The operator thus has the option of either purchasing the disinfectant fluid in bottles already mixed or possibly purchasing the concentrate such as soaps, disinfectants, paint pigments, epoxies and the like separately and mixing or diluting or proportioning them on site. Thus, there exists the dilemma that mixing is either accomplished at the place of manufacturing to bottle the diluted liquid cleaner or disinfectant for shipment as relatively heavy bulky product or employing a dedicated station at the industrial facility for refilling and mixing, both of which are undesirable and unsatisfactory solutions.

Efforts have been made to overcome these shortcomings by providing a proportioning system for attachment to, for instance, separate bottles of concentrate and dilutant. A device of this type is shown in U.S. Pat. No. 6,036,057 to Poutiatine. While serving to provide a convenient means for drawing fluid from a pair of containers and proportionally mixing same, such a device is rather complicated, expensive to manufacture and can prove inconvenient and unreliable in use.

At present, there exists an opportunity to mix concentrate with a dilutant in an applicator container. It has been recognized that it would be convenient to marry a concentrate cartridge with a dilutant container to be portable as a unit such that the cartridge would be readily available for removal and mixing of concentrate and dilutant in the applicator container. A device of this type is shown in U.S. Pat. No. 4,925,066 to Rosenbaum. Such devices suffer the shortcoming that their use is still labor intensive in that the user, to employ the benefits of the device, is required to detach the concentrate container and manually pour the contents thereof into the applicator container, a time consuming, messy and in the case of toxic products a risky task.

Other efforts have led to the proposal of a concentrate cartridge disposed in the neck of a mixing container and openable by twisting the top of the mixing container to break a seal. A device of this type is shown in U.S. Pat. No. 5,836,479 to Klima. While helpful in minimizing the exposure to concentrate, such devices have limited usage in that the concentrate cartridge is of limited size and volume and typically of single use thus necessitating frequent replacement thereof and consequent inefficiencies of use and generation of waste in the used cartridges.

SUMMARY OF THE INVENTION

The present invention includes a mixing container having a concentrate cartridge removably attached thereto and in fluid communication therewith for selective direct transfer of selected quantities of concentrate to the mixing container for dilution with water or the like.

One preferred embodiment includes a valve for controlling flow from the concentrate cartridge directly to the mixing container. In some modifications the value is housed in a separate housing containers and cartridges of similar construction.

Other features and advantages of the invention will become apparent from the following detailed description, taken in conjunction with the accompanying drawings which illustrate, by way of example, the features of the invention.

DETAILED DESCRIPTION OF THE PREFERRED EMBODIMENTS

Applicator bottles such as spray and squeeze bottles and the like have become a popular form of packaging for liquids such as cleaners and disinfectants. Such liquids are typically processed and manufactured to form a concentrate which is then mixed with a dilutant such as water to fill the bottles which are capped with, for instance, a cap or applicator device and packaged in cartons for shipment and storage. Filling of the bottles is a time consuming and labor intensive task. This process also results in the consumption of a high quantity of bottles which are typically plastic and requires handling of large volumes of liquid which housed, in shipping cartons, can be relatively heavy contributing to the fatigue and possible injury of workman in transporting and storing the liquid. As an example, a pallet of chemicals reconstituted with water may be made up of about 36 cases and weigh about 720 pounds. The total weight of concentrate in the 36 cases may be only a little over 100 pounds. Thus, it can be seen that a system for conveniently shipping the concentrate and ready mixing of the concentrate at the site of use could lead to great labor savings and diminish the volume of consumer consumption. It is an objective of the present invention to provide a convenient apparatus and method for containing, storage, shipping and mixing of a concentrate and dilutant at the situs of usage.

Figure 1:
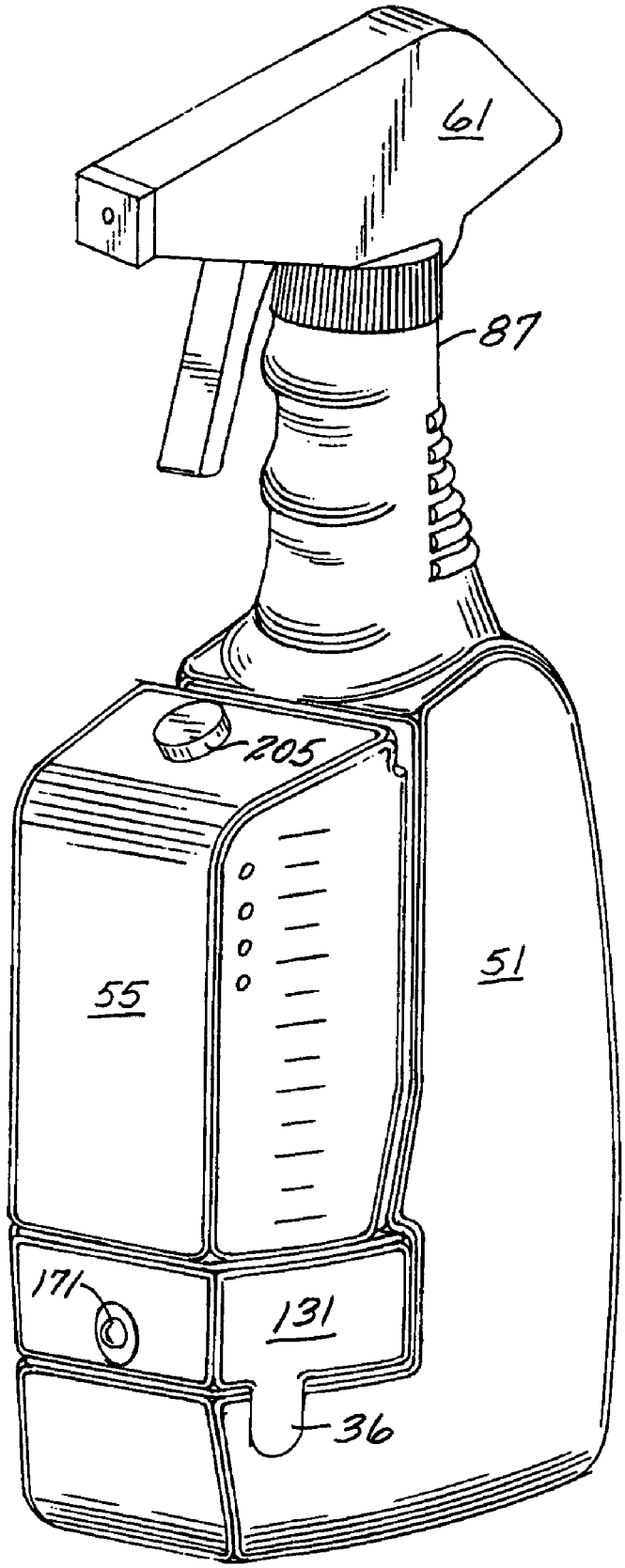
FIG. 1 is a perspective view of a combination applicator container and concentrate cartridge embodying our present invention.
Figure 2:
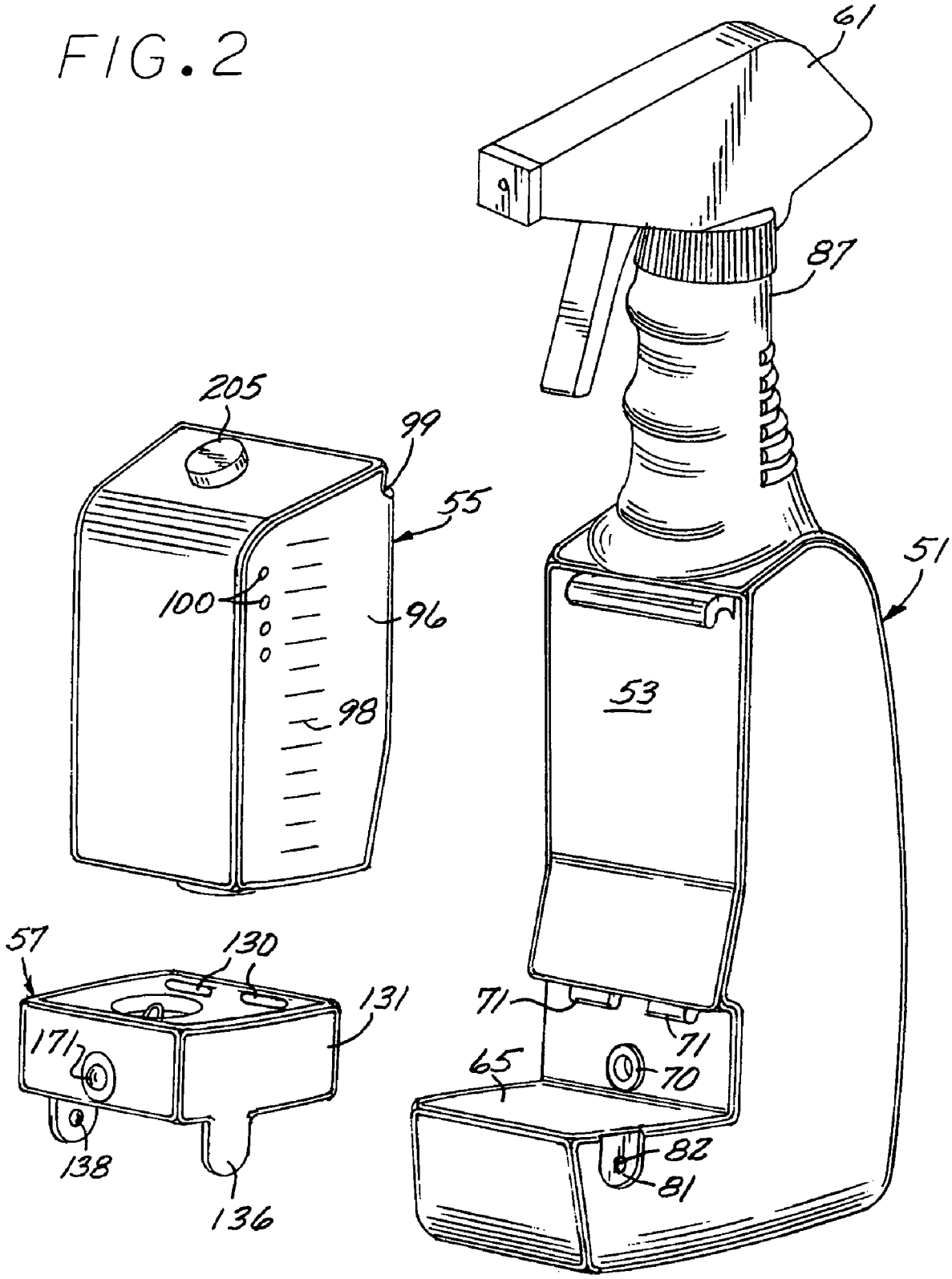
FIG. 2 is a perspective exploded view of the combination shown in FIG. 1.
Figure 3:
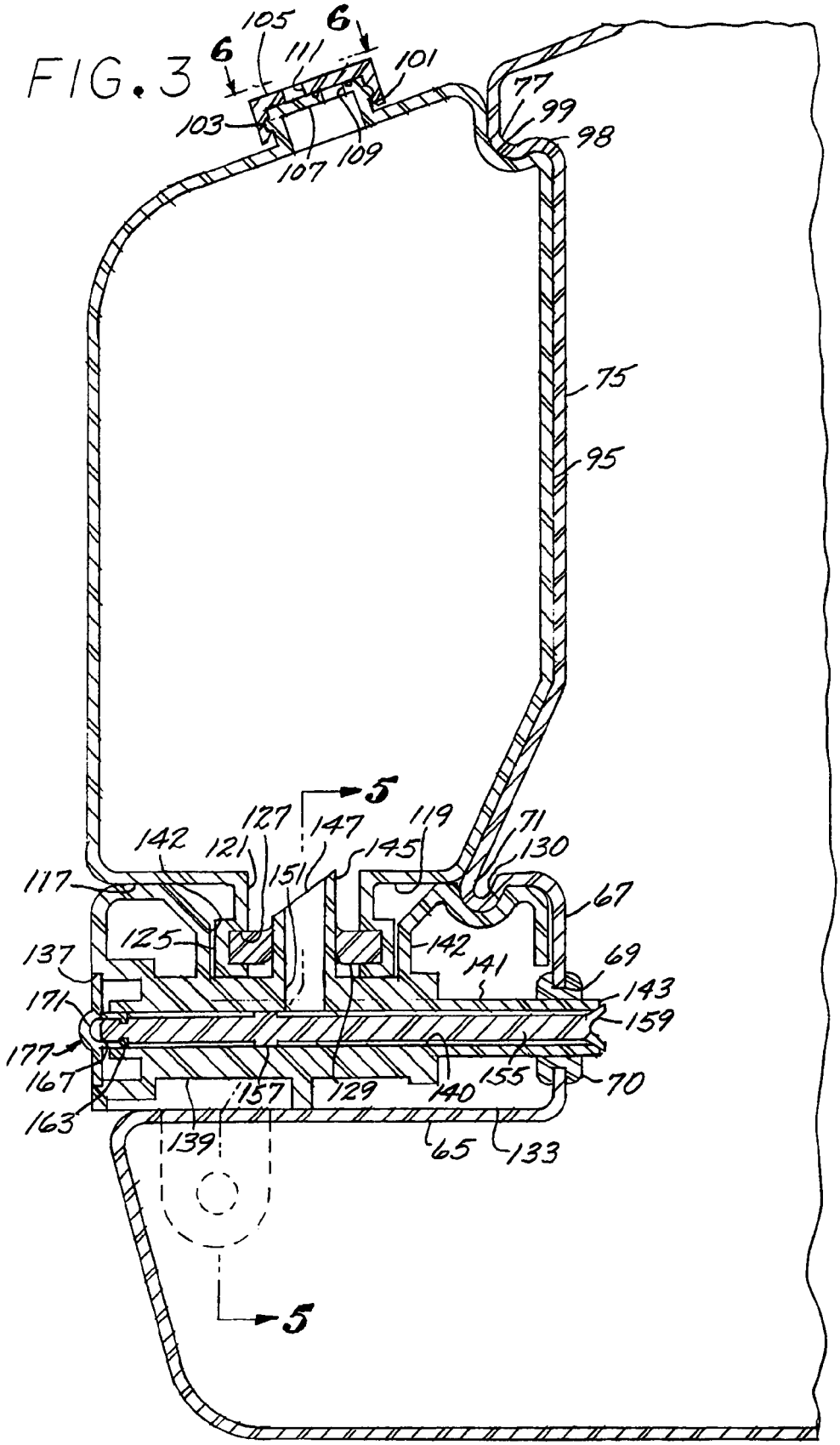
FIG. 3 is a vertical sectional view, in an enlarged scale, taken through the container and cartridge shown in FIG. 1.

Referring to FIGS. 1-3, the combination of the present invention may include generally, a mixing container 51 carrying, removably on the exterior thereof, a cartridge 55 from which flow of fluid is controlled through a transfer device 57 connected to a container inlet 59. Thus, the relatively compact cartridge 55 filled with concentrate is in fluid communication through the device 57 with the container 51 to dispense of a charge of concentrate to the container to be diluted with water or the like. The user may then conveniently use the container 51 to apply the reconstituted product through a spray head 61 or similar applicator or discharge.

The container 51 may take many different forms and is typically constructed of plastic such as polyethylene and may have a volume on the order of 28 ounces. The container 51 is conveniently formed with a recessed front wall configured with a horizontally disposed support wall defining a deck 65 (FIG. 3) which turns upwardly at the rear extremity to form a vertical stub wall 67 configured centrally with an inlet 69 to the container. Referring to FIGS. 2 and 3, the stub wall 67 curves upwardly and forwardly and is then formed with a pair of flanking downwardly projecting resilient catch rib 71. The wall then slants upwardly and rearwardly to turn vertically upwardly defining a laterally extending, forwardly facing vertical dock wall 75. The dock wall 75 is formed at is upper extremity to project forwardly and define an overhang configured with a downwardly projecting resilient holder flange 77. Referring to FIGS. 2 and 3, mounted in the inlet opening 69 is a sealing grommet 70.

The container is formed on its opposite sides, below the deck 65 with a pair of upwardly opening U-shaped recesses 81 formed centrally with respective detents 82.

Referring to FIG. 2, the container 51 is formed at its upper extremity with an upstanding neck defining a pistol grip 87 surmounted by a screw thread closure cap or the spray head 61. As will be appreciated by those skilled in the art, the application container acts as a mixing container and will serve as an instrument for applying the reconstituted fluid, as by the spray head or flexible container walls to form a squeeze bottle, a pump or even a drinking mouth or spout so that the container could be employed for reconstituted beverages such as energy flavored drinks.

The cartridge 55 has somewhat of a square horizontal cross sectional shape, having a top wall 95 that slopes upwardly and rearwardly and a lateral back wall shaped to compliment the shape of the dock wall 75 of the container. The wall 95 projects upwardly and turns forwardly and has an upwardly opening concave holder groove 99 formed at the upper extent thereof for releasably engaging the retainer flange 77.

Figure 7:
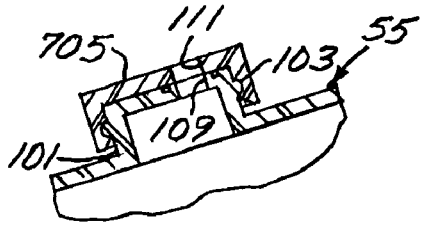
FIG. 7 is a transverse sectional view of the cap shown in FIG. 6 but with the cap vented.

The top wall of the cartridge is formed with an upwardly projecting neck 101 configured with an annular bead 103 onto which a cap 105 snaps. The neck 101 is formed with a top wall 107 formed with an eccentrically located breather aperture 109. The top wall of the cap 101 is also formed with an eccentrically located breather aperture 111 which can be orbited into registration with the aperture in 109 as shown in FIG. 7.

In the preferred embodiment, the cartridge 55 is shaped somewhat on the order of an inverted bottle and is formed with a bottom wall configured with flanking downwardly facing abutment shoulders 117 and 119 (FIG. 3). Formed in the bottom wall between the shoulders is a downwardly projecting neck 121 terminating in an annular outside bead 125 and formed with an interior annular gland 127 which receives in sealing engagement the periphery of a piercable septum 129.

Referring to FIGS. 2 and 3, the transfer device 57 includes a housing configured with a parametrical wall 131 terminating in a downwardly facing edge 133 setting on the deck 65. The housing is configured with a longitudinally projecting internal barrel, generally designated 139, (FIG. 3) defining a horizontal transfer passage 140 which steps down in external diameter centrally to form a horizontally projecting inlet tube 141 and which projects in sealing engagement through the grommet 70 and terminates at a free end 143. The barrel 139 is flared outwardly at its left end to merge into the face of the wall 131 to be formed with an outwardly opening circular undercut 137.

Referring to FIG. 3, the transfer housing is formed in its top side with a cylindrical recessed well 142 having a circular bottom wall and an upstanding penetration tube 145 rising concentrically upwardly and terminating in a chamfered penetration edge 147, the tube forming a central passage 151 opening downwardly into the horizontal transfer passage 140.

The transfer housing is formed centrally with a horizontal cylindrical barrel 141 defining a transfer passage 140 intersecting the passage 151. The opposite side walls of the valve frame 131 are formed with downwardly depending U-shaped ears 136 to be slip fit in the respective recesses 81 and formed with interior inwardly projecting buttons 138 configured to be releasably received in the respective detents 82.

Figure 4:
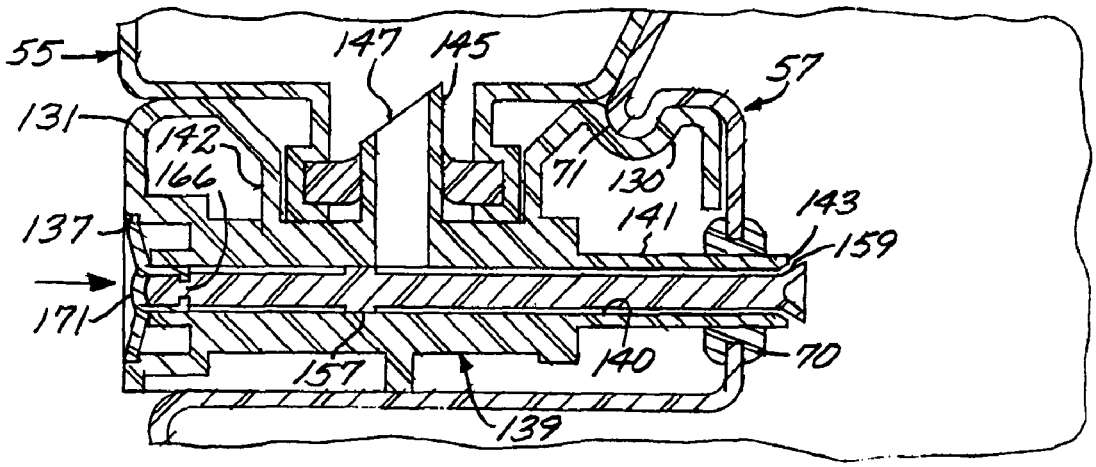
FIG. 4 is a partial sectional view showing a valve depicted in FIG. 3 but shifted to its open position.
Figure 5:
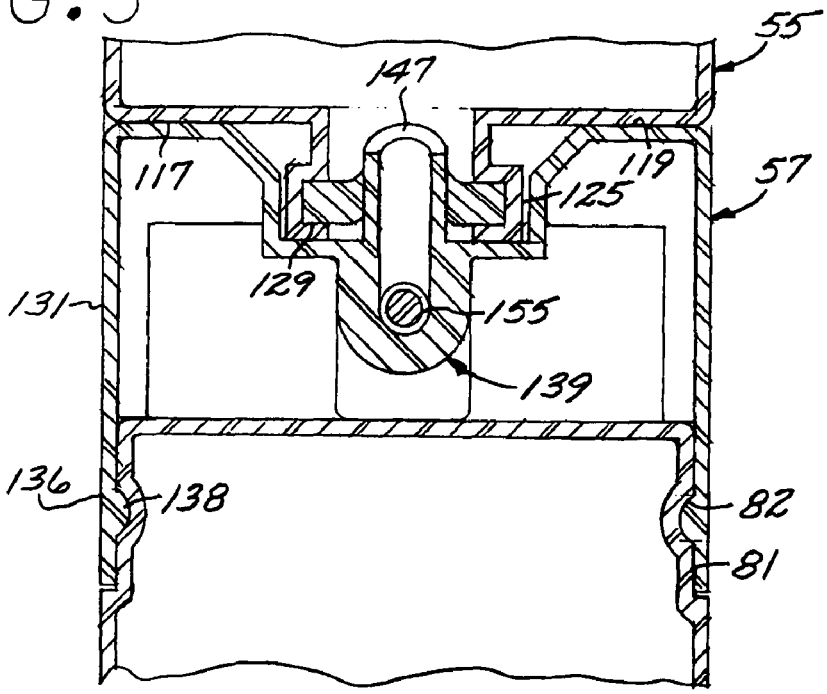
FIG. 5 is vertical sectional view taken along the lines 5-5 of FIG. 3.
Figure 6:
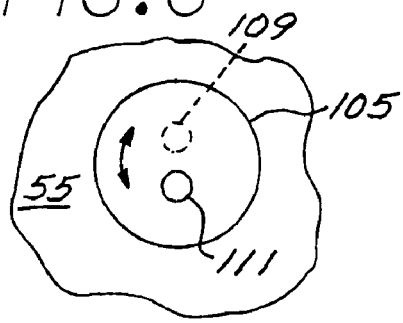
FIG. 6 is a partial top view taken along the lines 6-6 of FIG. 3 to depict a vent cap.

Received slidably within the transfer passage 140 is an elongated cylindrical poppet rod 155 formed medially with an enlarged in diameter annular bearing ring 157. The poppet rod is formed at its right end with a radially outwardly flared conical poppet 159 and is configured on its opposite extremity with annular, radially outwardly open peripheral gland 163. A resilient actuation cap, generally designated 177, is configured with a resilient circular disk 160 nested at its periphery in the gland 137 and formed centrally with an axially raised button 171. Projecting axially in the opposite direction for the button 171 is a central integral tube received concentrically over the end of the rod and formed at its free end with an inturned annular flange 166 received in the gland 163 (FIG. 4).

The cartridge 55 is preferably constructed of transparent poly vinyl chloride and is configured with a transparent wall defining a window 96 having volume indicator indicia 98 spaced vertically thereon. Also, formed on the window 96 are respective color code indicators 100 of respective individual colorations corresponding with a color agents in respective concentrates received in the cartridge to thereby indicate the nature of the concentrate itself.

Figure 8:
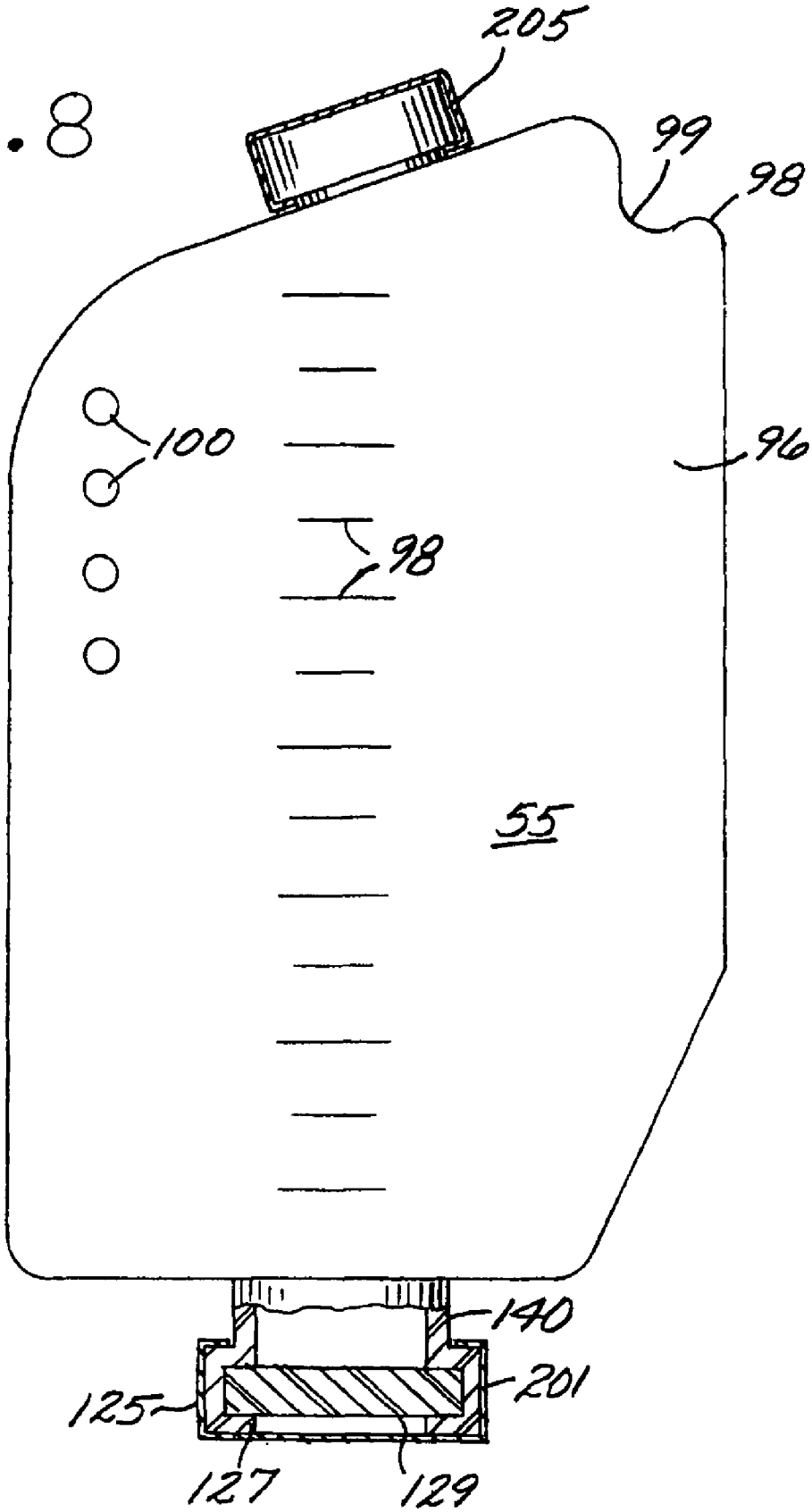
FIG. 8 is a side view, in an enlarged scale, partially broken away, of the cartridge shown in FIG. 2.

Referring to FIG. 8, it will be appreciated that the cartridge 55 is typically charged with a liquid concentrate, the sealing septum 129 inserted in place within the gland 177 and covered by an aluminum security foil 201 crimped about the peripheral bead 125. After the cartridge has been charged with a concentrate such as a disinfectant, the cap 105 will be rotated to position the eccentrically located cap aperture 111 out of registration with the aperture 109 of the end wall 107 to seal against fluid escape. A foil 205 may then be crimped about the periphery of the bead 125 to thus provide for detection in the event of tampering.

Referring to FIGS. 2, 3 and 8, it will be appreciated that a consumer will typically purchase the container 51, cartridge 55 and transfer valve 57, the cartridge pre-charged with the concentrate of choice. Typically, the consumer will purchase a number of cartridges of concentrate as, for instance, a full carton of 36 units, and store them for future use. Installation of the transfer assembly 57 and cartridge 55 is straight forward. The transfer assembly 57 is placed in position on the deck 65 flexing the ears 136 laterally outwardly to slide downwardly along the opposite side walls of the container 51 to register with the detents 81 and allow the buttons 138 to be received within the dimples 82 to hold the transfer assembly releasably in position. The assembly is pressed rearwardly along the top surface of the deck 65 to drive, the tube 141 rearwardly into the sealing grommet 70 to establish communication with the container. As the valve transfer assembly is brought into abutting relationship with the stub wall 67, the catch ribs 71 will be flexed upwardly out of its path by the rounded upper rear corners of the housing to ride thereover and be freed to flex downwardly into the respective grooves 130 formed in the top wall of the valve housing thereby holding the valve assembly in registration in the dock.

Figure 9:
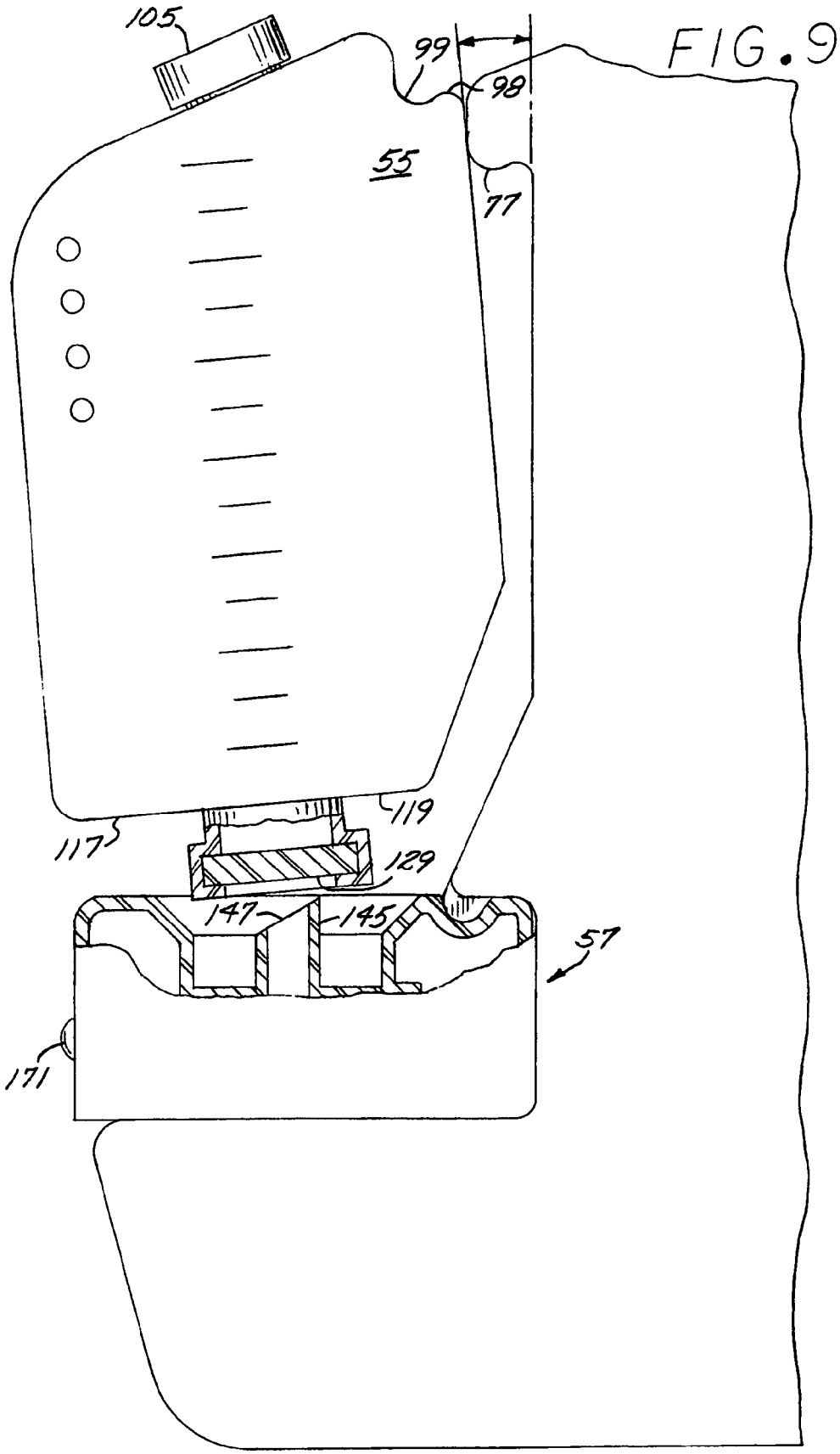
FIG. 9 is a side view of the combination cartridge and container shown in FIG. 1, in enlarged scale, and depicting the cartridge being attached.

Referring to FIG. 9, a cartridge 55 will be selected and the anti tamper seal 201 (FIG. 8) removed from the bead 125 to expose the septum 129 and the cartridge 55 moved into position with the dock with the shoulders 117 and 119 faced downwardly to engage the septum 129 with the top 147 of the tube 145. The shoulders 117 and 119 will be brought to rest on the top wall of the transfer assembly and, as the upper extremity of the cartridge is tilted rearwardly, the retainer lip 98 will be under the retainer flange 77 (FIGS. 3 and 9) to snap into place for releasable holding engagement therewith. The close fit of the cartridge and transfer assembly in the dock causes the resilient retaining flange 77 to maintain the cartridge 55 urged downwardly to maintain the shoulders 117 and 119 pressed downwardly on top of the valve transfer housing to cooperate in holding the components firmly in place with the grommet 129 forming a seal around the transfer tube 145.

When, it is desirable to introduce concentrate into the mixing and applicator container 51, the user may merely depress the transfer control button 171 (FIGS. 1 and 4) to flex the spring disk 171 and translate to the poppet rod to the right thus lifting the poppet 159 off the seat 143 so the fluid head above the transfer tube will initiate gravity flow into and through the transfer passage. The user may observe an indication of the volume flowed from the cartridge through the window 96 to approximate the quantity of concentrate by observing the amount by which the top surface of the concentrate is lowered relative to the indicia 98. Also the user may observe the color of the concentrate and compare it with the coded indicia 100 so the user can be assured that the contained concentrate has the coloration for the concentrate identified with the particular task at hand.

When the user observes that the desired quantity of concentrate has been flowed from the cartridge to the container, the transfer button 177 may be released allowing the spring disk to draw the valve rod back to the left to the position shown in FIG. 3 to close the poppet 159 on the seat 143 and strip flow. The spray head 61 or any other closure device employed may then be removed and the desired quantity of dilutant, such as water added from a spigot or the like to form the mixture of the desired ratio. The spray head is then reattached. The user may then go about his or her duties in actuating the spray head 61 to spray the mixture from the container 51 to the particular work surface to accomplish the desired task.

When the cartridge 55 have been depleted, the user may conveniently grasp the cap 105 and, using the lip as a handle, draw the top end of lip 98 from underneath the retaining flange 99 (FIG. 3) to thus free the upper end of the cartridge so that it may be drawn upwardly and outwardly to fully disengage the cartridge itself so it may be discarded and replaced with a new fully charged cartridge. In this regard, it will be appreciated that the cartridge 55, being of a relatively small volume, incorporates a relatively small amount of plastic to be discarded with each particular cartridge as the contents are depleted.

Figure 10:
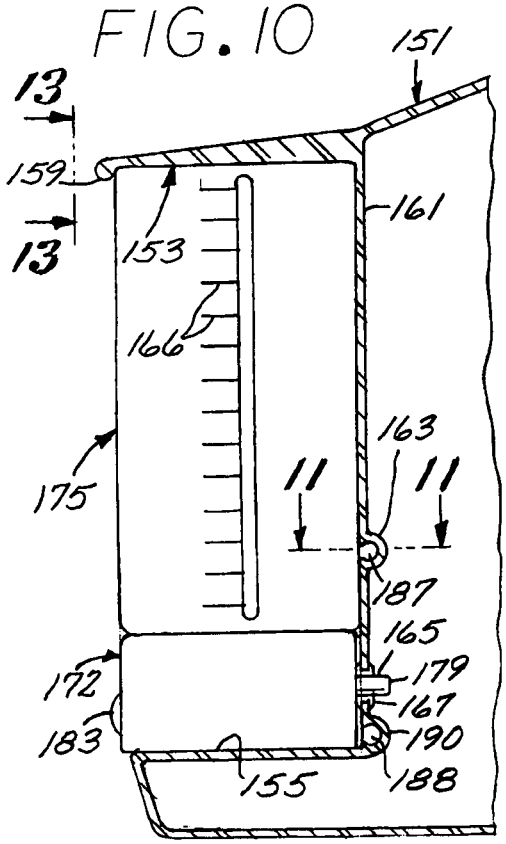
FIG. 10 is a vertical sectional view of a second embodiment of the combination container and cartridge of the present invention.
Figure 11:
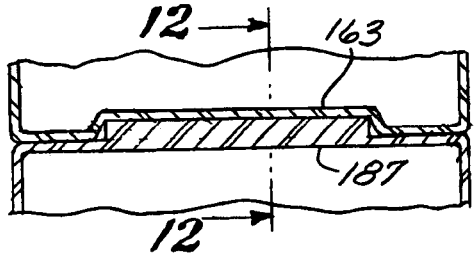
FIG. 11 is a horizontal sectional view, in an enlarged scale, taken along the lines 11-11 of FIG. 10.
Figure 12:
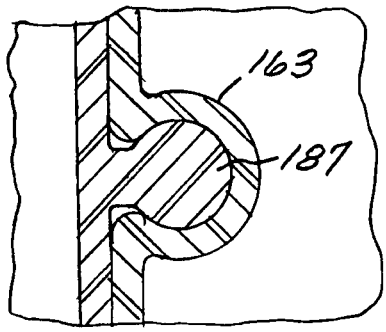
FIG. 12 is a vertical sectional view taken along the lines 12-12 of FIG. 11.
Figure 13:
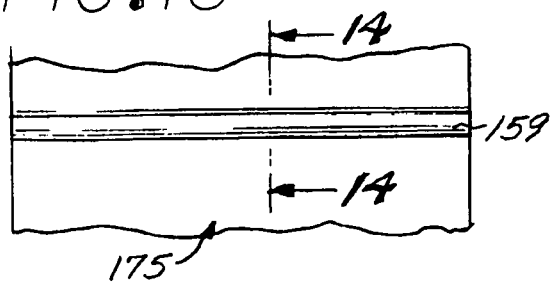
FIG. 13 is a partial front view, in an enlarged scale, taken along the lines 13-13 of FIG. 10.
Figure 14:
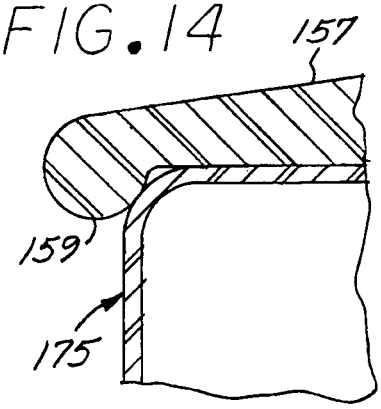
FIG. 14 is a partial sectional view, in an enlarged scale, taken along the line 14-14 of FIG. 13.

Referring to FIG. 10, a second embodiment of the combination cartridge and container of the present invention includes, generally, a container 151 formed in its front wall with a forwardly opening holder cavity 153 formed on its bottom side with a horizontal support deck 155 and configured on its top side with a forwardly projecting holder catch arm 157 configured at its free extremity with a downwardly turned rib defining a holder finger 159. The holder cavity 153 includes a vertical back wall 161 formed with forwardly opening semi cylindrical hollow retainer catch ribs and 190 spaced vertically apart tube 163. Such back wall is configured in its lower extremity with an inlet port 165 receiving a sealing grommet 167.

A fluid transfer device, generally designated 172, sits on the deck 155 and is configured with a communication passage leading from a connecting port between a container, generally designated 175, received in the holder cavity 153 and a corresponding inlet in the housing of the transfer device 171, the passage leading to a tube 179 projecting through the grommet 167. A valve is incorporated in the passage controlled by a valve button 183 at the front of the transfer device. The container 175 is formed on its back with horizontally projecting cylindrical bead 187 configured to be received in snap fit relationship within the forwardly opening hollow catch rib 163.

In operation, it will be appreciated that as with an apparatus of embodiment 10 a quantity of cartridges 173 may be filled with concentrate and shipped separately from the container 151. When it is desirable to apply a mixture from the concentrate, the transfer device 172 may be inserted on the deck 155 with the bead 188 snapped into the retainer rib 190 to hold the transfer assembly and thus the transfer tube 179 in place within the sealing grommet 167. In some embodiments, the container 175 merely includes a downwardly projecting puncture tube projecting downwardly from its bottom wall and received in a pre-pierced septum in the top wall of the transfer device 172 for introduction of fluid into the passage leading to the tube 179. The valve control button 193 may be depressed to control flow of fluid through the tube 179 and into the container 151.

A selected amount of concentrate will be introduced into the container 151 as dictated by the level of the fluid flowing relative to the level indicia 166 on the wall thereof Dilutant may then be introduced to the container 151 through an inlet (not shown) to reconstitute the concentrate to the level of concentration desired. When it is desired to use the container 151 the reconstituted fluid may be emitted therefrom through the neck of the container, through an applicator spray (not shown), by pressurization and by squeezing the walls of the container or any other desirable method of flowing fluid from such container.

Figure 15:
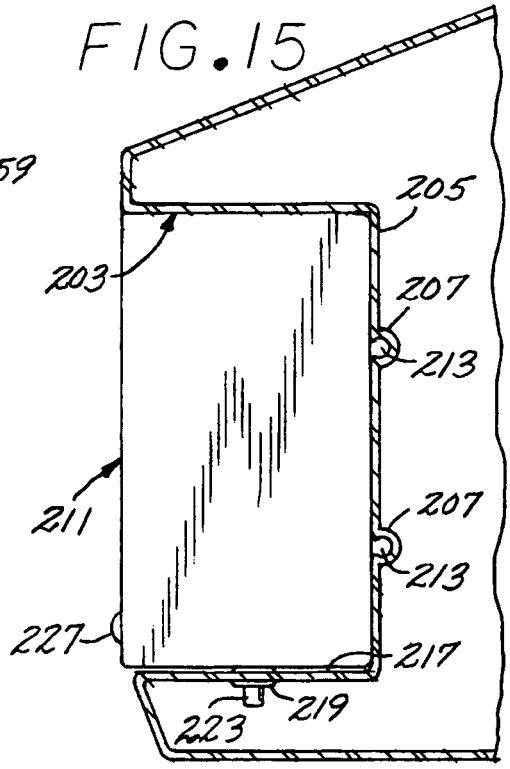
FIG. 15 is a vertical sectional view of a third embodiment of the combination applicator container and concentrate cartridge of the present invention.

Referring to FIG. 15, a third embodiment of the combination cartridge and container apparatus of the present invention includes, generally, a flexible wall container 201 formed in its front wall with a forwardly opening holder cavity 203 is formed with a back wall 205 having forwardly opening cylindrical hollow holder ribs 207 formed therein. A container, generally designated 211, is formed with self supporting flexible walls and is shaped to compliment the shape of the cavity 203 to be complementally received therein. The container is formed on its back wall with a pair of semi cylindrical horizontal ribs 213 for snap fit receipt in the respective ribs 207.

The container is formed at the bottom of the holder cavity 203 with a horizontal wall defining a deck 217 formed with an inlet bore which receives a sealing grommet 219.

Incorporated in the bottom wall of the cartridge 211 is a transfer tube (not shown) which projects a short distance up into the interior of the cartridge and further projects downwardly to form an inlet tube 223 received in sealing engagement with the grommet 219 for selectively transferring fluid from the cartridge to the container. A valve passage is formed in the upper extremity of the tube 223 and flow therethrough is controlled by means of a valve biased to its closed position and operated by a valve button 227.

In operation, the apparatus shown in FIG. 15 involves the supply of a quantity of concentrated cartridges 211 for selective receipt in the cavity 203 of the container 201. When it is desirable to insert a cartridge 211, the user will flex the bottom wall of such cartridge upward slightly to slide the lower extremity of the tube 223 over the surface of the deck 217 to be slid in sealing engagement downwardly through the grommet 219. It will be appreciated that the self-distending flexible walls of the cartridge 211 will be operable to maintain the cartridge generally fitted into the holding cavity 213. When it is desirable to introduce concentrate into the container 201 the valve button 227 may be depressed to introduce a selected quantity of concentrate.

Referring to FIGS. 16-21, a forth embodiment of the cartridge and container apparatus of the present invention includes, generally, a container 231 configured in its front wall with a holder cavity 233 which is open on its front side and is formed with a horizontal bottom wall defining a deck 235. The deck 235 is formed with a through bore receiving a sealing grommet 237.

Figure 16:
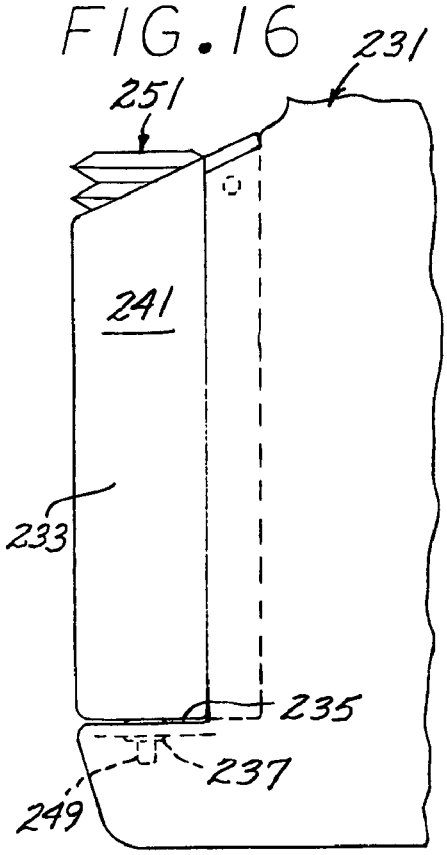
FIG. 16 is a side view of a fourth embodiment of the combination applicator and concentrate cartridge of the present invention.
Figure 17:
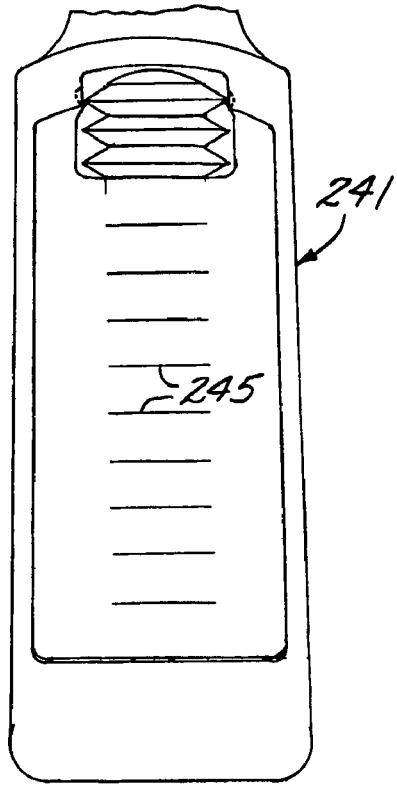
FIG. 17 is a front view of the combination shown in FIG. 16.
Figure 18:
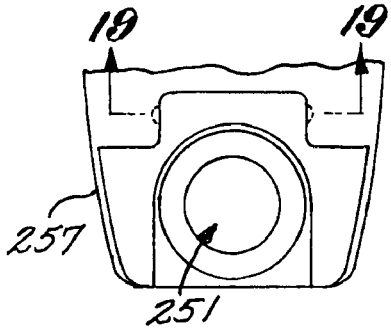
FIG. 18 is a top view of the combination shown in FIG. 16.

A cartridge, generally designated 241 is constructed to be complementally received within the cavity 233. The cartridge 241 is formed in its front side with a transparent wall having indicia 245 spaced vertically there along to indicate the level of fluid contained therein. The cartridge 241 includes a transfer device including a check valve checking flow out an inlet tube 249 depending from the bottom wall and constructed to be sealingly engaged through the grommet 237 as shown in FIG. 16.

The cartridge 241 includes in its top extremity a pressurizing pump. In one embodiment such pressurizing pump is in the form of a bellows pump, generally designated 251.

Figure 19:
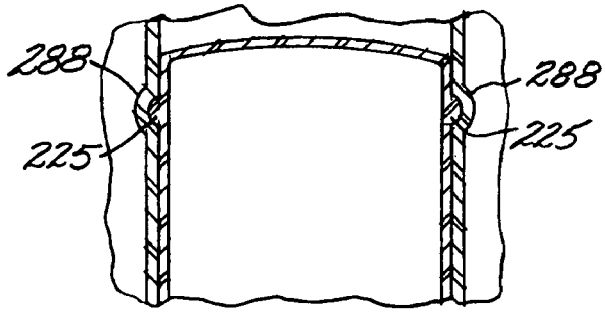
FIG. 19 is a vertical sectional view, in an enlarged scale, taken along the line 19-19 of FIG. 18.

In one preferred embodiment, the container 231 is formed to define the cavity 233 with side walls spaced laterally apart and formed with respective aligned inwardly facing dimples 255 (FIG. 19). The cartridge 241 is formed in its upper extremity with a collar 257 which is formed with laterally spaced apart walls configured with aligned laterally outwardly projecting nubs 288 releasably received within the respective dimples 255.

Figure 20:
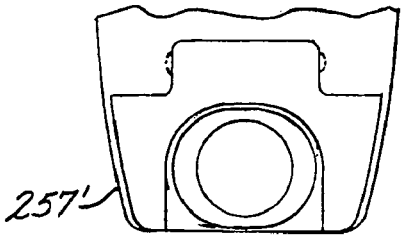
FIG. 20 is a top view of a modification of the combination shown in FIG. 16.
Figure 21:
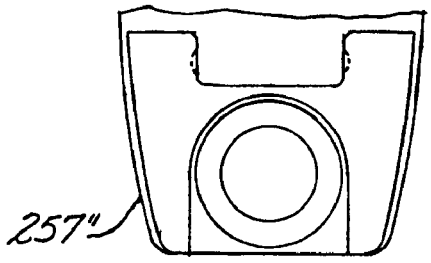
FIG. 21 is a top view of a modification of the combination shown in FIG. 16.

Referring to FIGS. 20 and 21, other modifications of the collar 257 in the form of collars 257' and 257" may be incorporated in the third embodiment of the present invention.

In operation, it will be appreciated that a container 231 may be utilized with multiple different cartridges 241. When a cartridge 241 becomes depleted, the cartridge may be removed from the cavity 231 by merely snapping the holder nubs 288 out of the respective dimples 255 to free the empty cartridge. When it is desirable to insert a recharged cartridge, the full cartridge may be inserted into the cavity 233 with the stem tube 249 to be received through the grommet 237 and the nubs 288 of the new replacement cartridge snapped into the respective dimples 255.

Then, when the concentrate from the cartridges is to be introduced into the container 231, the workman may depress the bellows pump 251 to apply pressure thereto and overcome the spring bias in the check valve controlling flow through the stem tube 249 to introduce a selected quantity of concentrate into the container 231. The concentrate will then be mixed with dilutant and will be ready for use as, for instance, a reconstituted disinfectant, cleaner or even a beverage.

Figure 25:
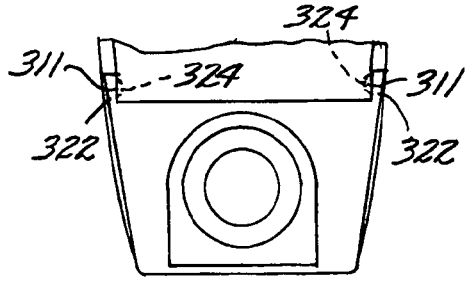
FIG. 25 is a top view of the combination shown in FIG. 24.

Referring to FIGS. 22-25, in a fifth embodiment of the combination cartridge and container of the present invention, a container 301 is configured in one wall with a forwardly opening holder cavity 303 configured in its lower portion with a horizontal bottom wall defining a holder deck 305. The back wall of the cavity 303 is formed with a plurality of rearwardly recessed forwardly opening tubular holder retainers 307. The container is formed in the upper extremity with a shoulder having opposite side walls configured with inwardly depressed dimples 311 (FIG. 25). The back wall of the cavity is further formed in its lower extremity at the back of the deck 305 with a through bore for receiving a sealing grommet 315.

A cartridge, generally designated 319 is complementally shaped for receipt in the cavity 303 sitting on the bottom deck 305.

Figure 22:
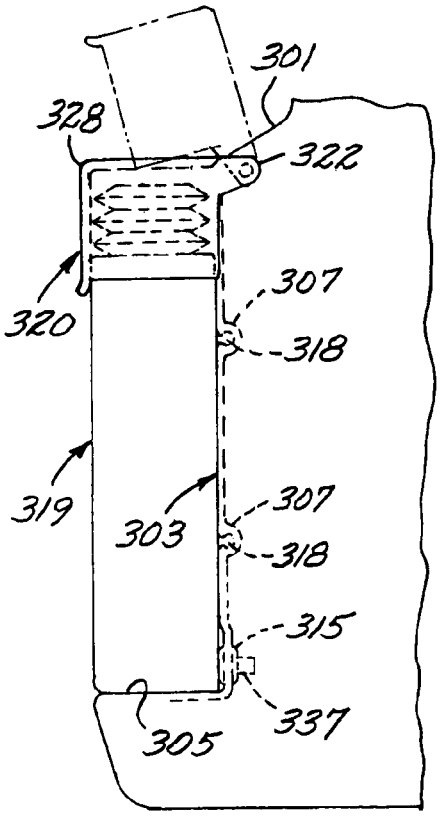
FIG. 22 is a partial side view of a fifth embodiment of the combination applicator container and concentrate cartridge of the present invention.
Figure 23:
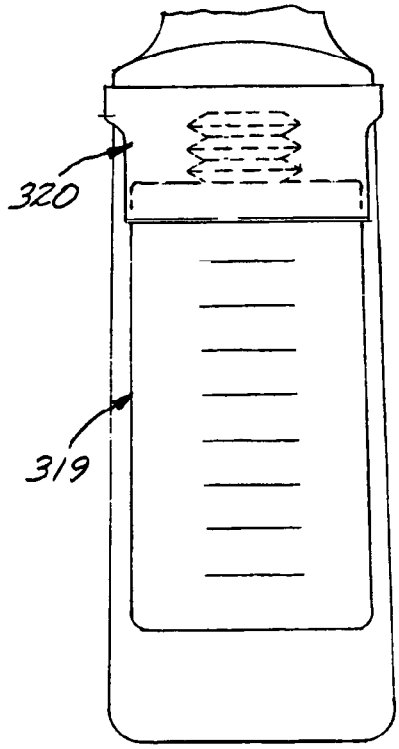
FIG. 23 is a front view of the combination shown in FIG. 22.
Figure 24:
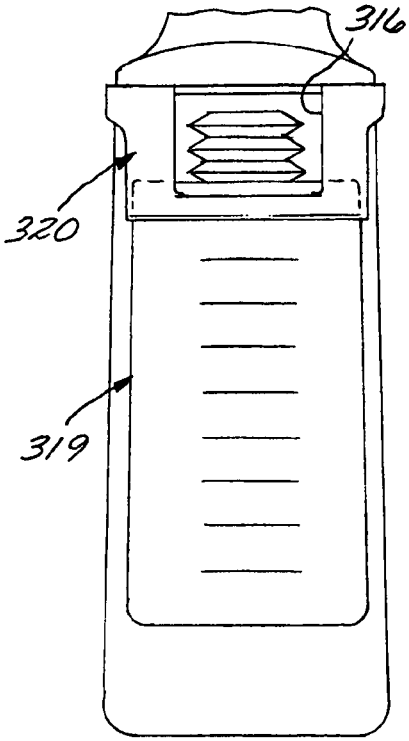
FIG. 24 is a front view of a modification of the combination shown in FIG. 23.

A holder cap, generally designated 320 is constructed with a pair of laterally spaced apart rearwardly projecting ears 322 which abut the opposite side walls of the container and are formed with inwardly projecting aligned buttons 324 releasably received in snap fit relationship within the dimples 311 for pivotal rotation of the cap 320 between the release position showing in broken lines in FIG. 22 and the lower holding position shown in solid lines.

As shown in FIG. 25, the retainer holder cap 320 may be formed with a forwardly and upwardly opening window 316 for ready access to the pump 328.

The cartridge 319 is constructed with a tube projecting rearwardly from the lower portion of the back wall, incorporating a spring loaded check valve serving to moveably resiliently block flow through a inlet stem of such tube defining it in inlet tube 337 (FIG. 22). The back wall of the cartridge is configured with vertically spaced apart horizontal beads 318 to be releasbly caught in the respective ribs 307.

As in the embodiments of FIGS. 1-3, the cartridges 319 (FIG. 22) may be pre-charged with concentrate and will be mounted in holding relationship on the container 301 similar to that described previously. That is, the holder cap 320 may be pivoted to its raised position shown in broken lines in FIG. 22 and the cartridge 319 slated into position driving the inlet tube 337 through the grommet 315 to establish fluid communication while the bead 318 are snapped into holding relationship and to catch ribs 307.

Then, when concentrate is to be introduced to the container 301, the bellows pump 328 maybe press fluid downwardly to overcome the bias of the flow control valve in the tube defining the inlet stub for the inlet tube 337.

Figure 26:
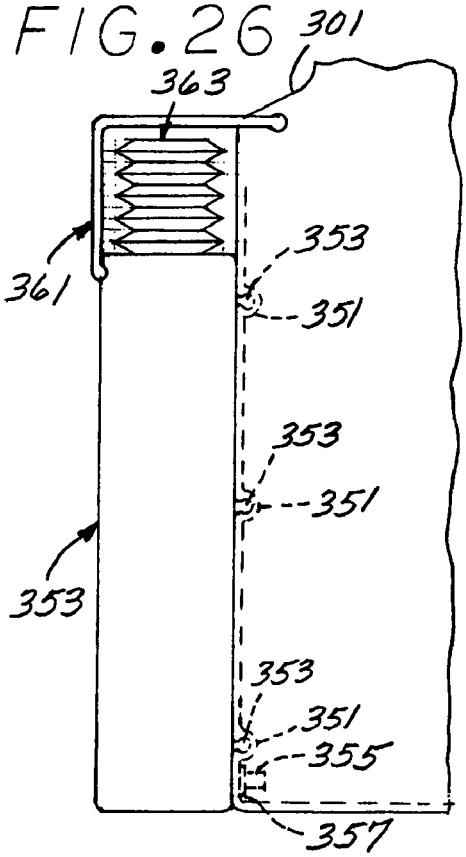
FIG. 26 is a side view of a modification of the combination shown in FIG. 22.

Referring to the modification shown in FIG. 26, the container 301 may be formed with a side wall configured with horizontally projecting hollow retainer ribs 351 opening forwardly for receipt of complimentarily beads 353 formed in the back wall of a cartridge, generally designated 355. The cartridge 355 may include in its bottom wall an inlet tube 355 projecting through a sealing grommet 357 in the wall of the container 301 with flow there through controlled by a flow control valve operable upon application of a predetermined pressure thereto to open and establish flow. The container 301 pivotally mounts a cartridge retainer, generally designated 361 which selectively captures the upper extremity of the cartridge to hold in its position shown in FIG. 26. The cartridge includes a bellows pump, generally designated 363 which may be depressed to drive concentrate from the cartridge through the inlet tube 255.

Figure 27:
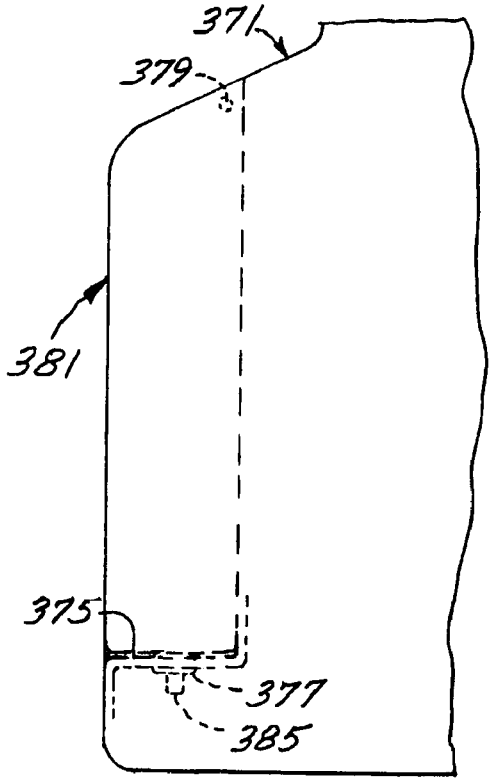
FIG. 27 is a side view of a sixth embodiment of the combination applicator container and concentrate cartridge of the present invention.
Figure 28:
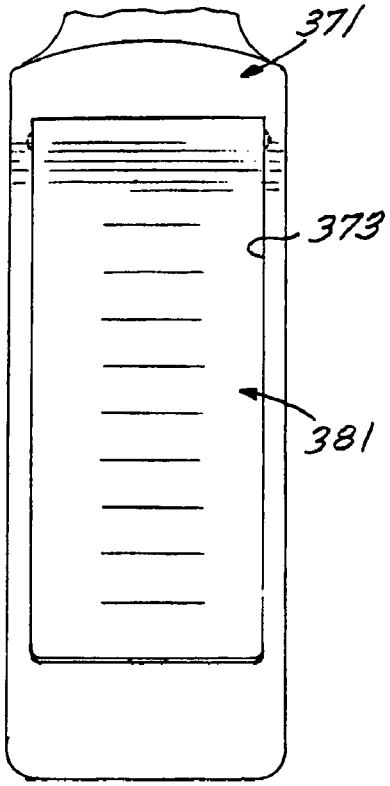
FIG. 28 is a front view of the combination shown in FIG. 27.
Figure 29:
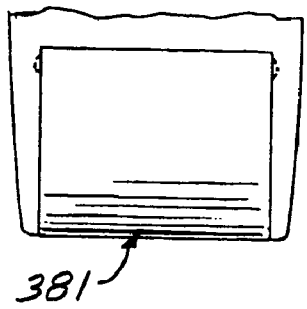
FIG. 29 is a top view of the combination shown in FIG. 28.

Referring to FIGS. 27-29, a fourth embodiment of the combination, container and cartridge apparatus of the present invention may include, generally, a container 371 formed in one wall with a recessed cavity 373 configured in its bottom portion with a horizontal wall defining a deck 375 formed with an inlet bore mounting a sealing grommet 377. The walls at the opposite side of the cavity 373 may be formed with laterally aligned dimples 379.

A cartridge, generally designated 381, is configured for complemental receipt in the cavity 373 and includes in its lower wall a tube mounting in the upper extremity thereof a control valve including a valve seat having a poppet bias there against to open under a predetermined magnitude of pressure, such tube projecting downwardly through the grommet 387 to form an inlet tube 385. The cartridge 381 is formed in its upper extremity with a pair of oppositely projecting aligned nipples releasably received in the respective dimples 379 to releasably hold the cartridge 381 and the holder cavity 373.

In one embodiment the walls of the cartridge 381 are compressible such that, when concentrate is to be ejected therefrom, the depressable wall may be depressed to pressurize the concentrate therein and overcome the pressure of the bias spring on the poppet (not shown) to introduce a selected amount of fluid through the inlet tube 385. To this end, the cartridge 381 may be formed with filler inlet or other vent having, for instance, a one way flapper valve to allow air to be drawn into the upper extremity thereof but blocking release of air or fluid from the cartridge to cooperate with the compressible wall to act as a fluid pump.

Figure 30:
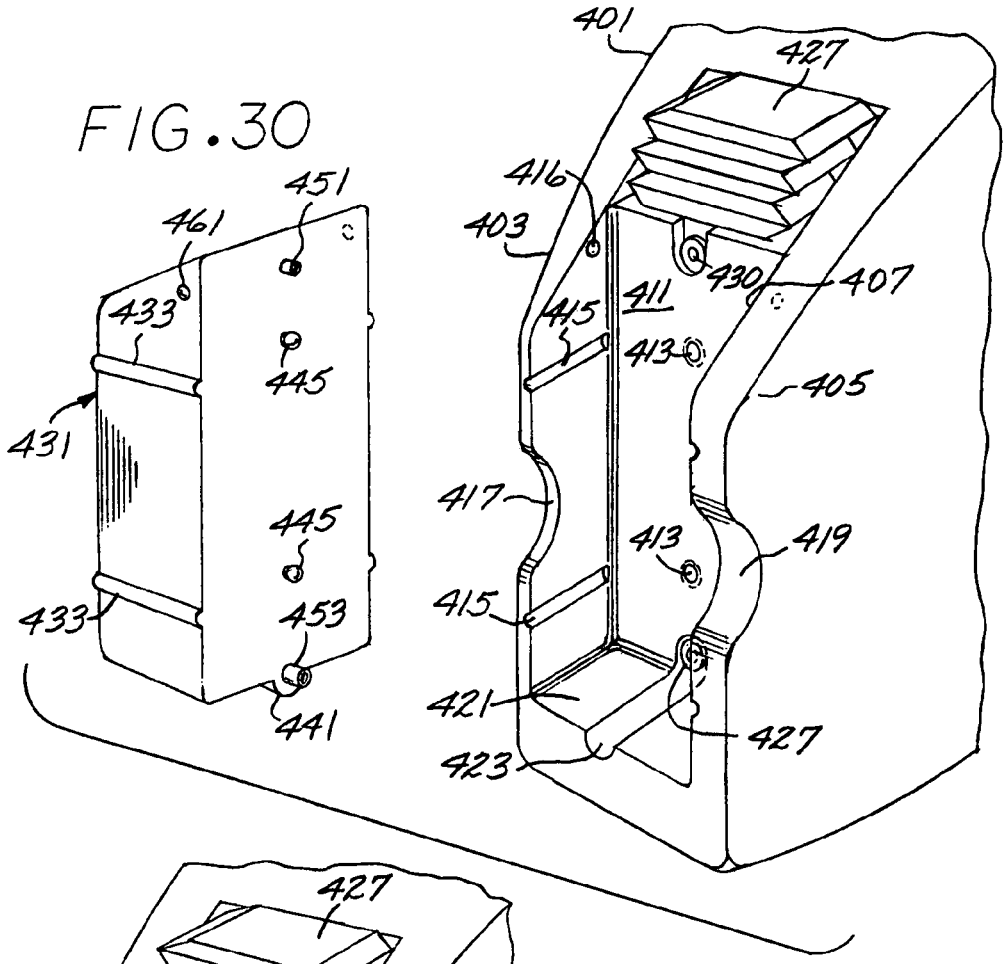
FIG. 30 is an exploded perspective view of a seventh embodiment of the combination applicator container and concentrate cartridge of the present invention.
Figure 31:
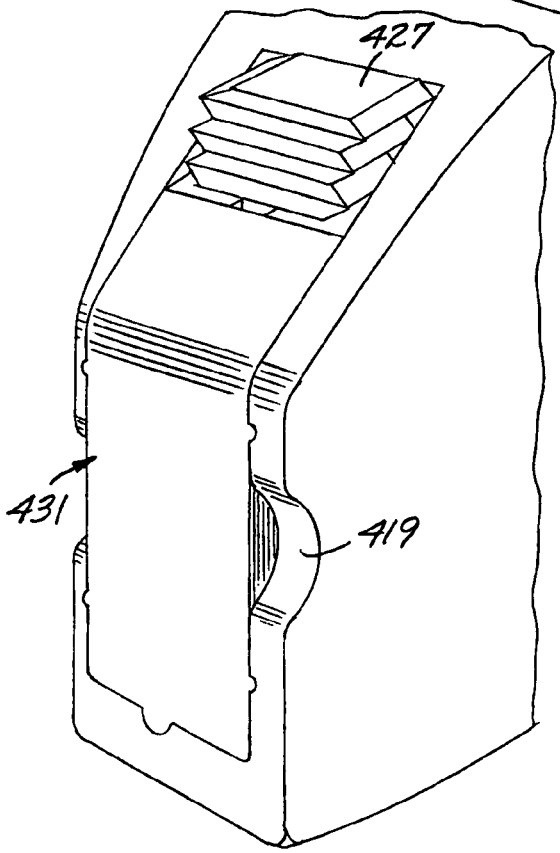
FIG. 31 is a perspective view of the combination shown in FIG. 30 but the components assembled.
Figure 32:
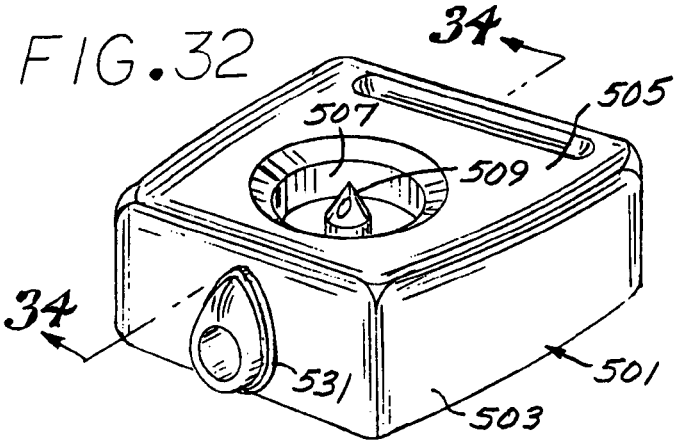
FIG. 32 is a perspective view of a modification of the transfer device included in the embodiment depicted in FIGS. 1-9.
Figure 33:
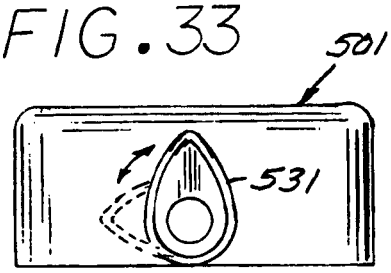
FIG. 33 is a front view thereof.

Referring to FIGS. 30 and 31, a sixth embodiment of the combination container and cartridge apparatus of the present invention includes, generally, a container configured with a pair of side walls 403 and 405 cooperating to define a cavity 407 having a back wall 411 which is configured with a pair of vertically spaced holder sockets 413 having a bulbous interior and a reduced in cross section neck defining the opening thereto. The side wall flanges 403 and 405 are formed on their interior walls with pairs of respective horizontal, forwardly opening groove tracks 415 such flanges 403 and 405 are further configured at their forward extremities with respective finger access cutbacks 417 and 419. Formed in the upper portion of the container 401 is a bellows pump 427 for selectively pressurizing the container.

The cavity is formed in its lower portion with a horizontal wall defining a deck 421 configured with an open ended upwardly opening trough 423. The back wall 411 is formed at the back extremity of the groove 423 with an inlet bore receiving a sealing grommet 427. The wall 411 is formed in its upper extremity with a pressure port receiving a sealing grommet 431.

A cartridge, generally designated 431, is complementally shaped to be received in the cavity 407 and includes on its opposite sides respective rails 433 for sliding receipt in the respective tracks 415. The cartridge is formed as a bottom wall with a centrally located downwardly projecting elongated rib 441 for complementally receipt in the groove 423 formed in the deck 421. The container is configured in its back wall with a pair of holder knobs 445 for respective receipt in the respective sockets 413.

The cartridge 431 includes at the upper portion of its back wall a rearwardly projecting pressurizing tube 451 configured to be received in the grommet 430. Such cartridge is formed in the lower portion of the back wall with a rearwardly projecting fluid communication tube 453 constructed for selective receipt in sealingly engagement with the grommet 427.

The side walls of the cartridge 431 are formed with a pair of opposite leg projecting buttons 461 constructed for selected receipt in the respective dimples 416 in the side flanges 403 and 405.

As will be appreciated by those skilled in the art, in this embodiment the cartridges 431, pre-charged, can be readily installed in the container 401 by sliding the cartridge rearwardly in the cavity 407 with the rails 413 received in the grooves 415 and the rib 441 received in the groove 423. The cartridge will be pressed into position driving the pressurization tube 421 into the grommet 430 and the fluid inlet tube 433 into the grommet 427 as the holder knobs 445 are received in the holder sockets 413 for snap fit thereinto. Concurrently, the buttons 461 will be received in snap fit relationship in the dimples 416.

By pressurizing the bellows 427 trapped air will be forced through the pressurizing tube 451 to be applied to the top surface of the concentrate in the cartridge 431 raising the pressure thereon to thus overcome the pressure of the force of the spring and the valve controlling flow through the inlet tube 433 to thus introduce the desired amount of concentrate into the container 401. As such bellows reciprocate, on the expansion stroke air will be drawn in from the atmosphere through a flapper valve to pressurize on the next stroke.

Referring to FIGS. 32-35, a transfer device generally designated, 501 is provided as a modification of that shown in FIGS. 1-9 and includes, generally, a housing 503 formed in its top wall 505 with a well 507 concentric about upstanding spike defining a tube 509 having a vertical open ended passages 510 leading downwardly and disposed in vertical alignment with the interior 512 of an inlet tube 511 (FIGS. 34 and 35) which is slidably received in sealing engagement with a grommet 513 in the wall 515 in the deck of the container 51.

Figure 34:
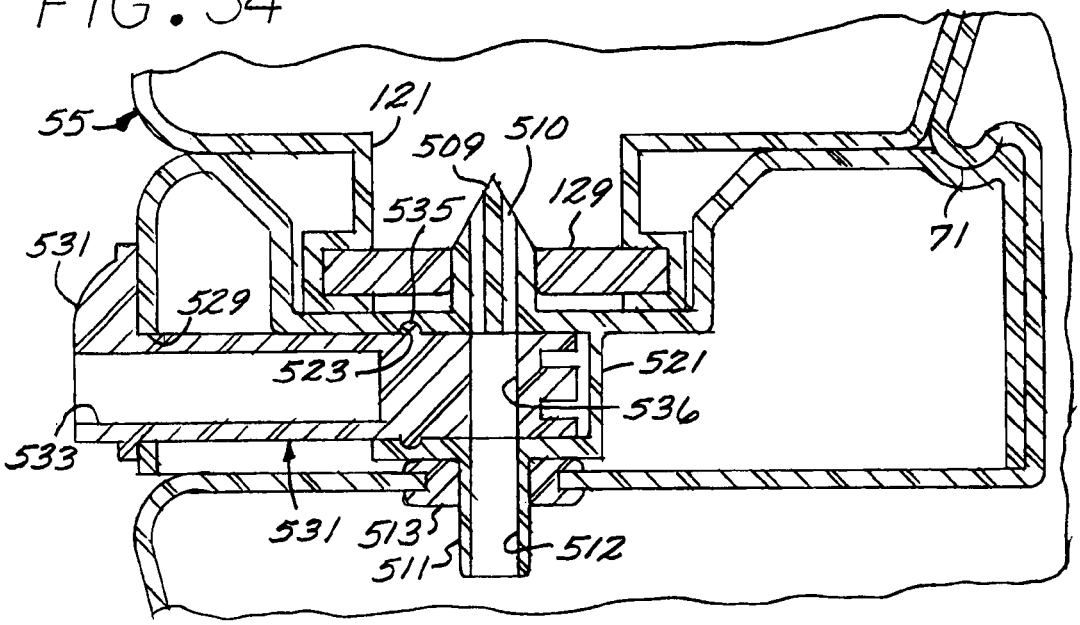
FIG. 34 is a longitudinal sectional view, in enlarged scale, taken along the lines 34-34 of FIG. 32 and showing a push/pull valve.

The transfer device 501 is formed internally with a horizontally projecting barrel 521 which opens to the left as viewed in FIG. 34 and is formed to position the spike 509 and tube 511 in diametrically opposed positions and is further formed along its length with in an annular retainer groove 523. The barrel opens to the left and is disposed in horizontal alignment with a bore 527 in the front wall of the housing 503.

Figure 35:
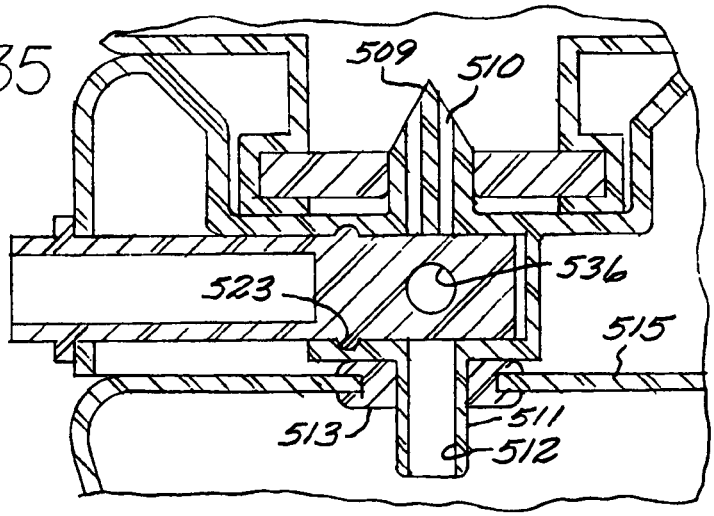
FIG. 35 is a partial sectional view as shown in FIG. 34 but with the valve in its closed position.

With continued reference to FIGS. 34 and 35, received concentrically within the barrel 521 is a resilient plastic rotary poppet rod, generally designated 531. The rod projects the bore 529 and is formed at its left extremity with a radially outwardly expanding tear dropped shaped control knob 531 and is formed centrally with an axial blind lightening bore 533. The knob 531 is formed medially along its length with its radially outwardly projecting bead 535 which is received in releasable engagement in the groove 523 to releasably retain the rod in position within the barrel 521.

As will be appreciated by those skilled in the art, the modified transfer device 501 may be placed on the deck wall 515 similar to placement on the deck wall 65 of FIG. 2 to insert the inlet tube 511 into sealing engagement through the grommet 513 and to engage the catch rib 71 to hold the transfer device in place.

The cartridge 55 may then be moved into the dock with the spike 509 piercing the system 129 to establish fluid communication through the passages 510.

As long as the control knob 531 remains in the position shown in FIG. 35 with the diametrical bore 536 cross wise in the horizontal position, the rod 531 will block flow from the passages from 510 to the passage 512 of the inlet tube 511. When it is desirable to transfer concentrate from the cartridge 55, the control knob 531 may be rotated to the position shown in FIG. 34 to align the diametrical passage 536 as shown for transfer of fluid or granula from the cartridge 555.

From the foregoing, it will be apparent that the combination cartridge and container of the present invention provides a straightforward device for the containment, shipping and storage of concentrate for convenient and efficient mixing with high volumes of dilutant at the site of use.

We claim:

1. A combined applicator container and concentrate cartridge device comprising:

an applicator container formed with a recessed holder wall disposed above a generally horizontally projecting bottom wall defining a support deck and a stub wall projecting between the recessed holder wall and deck, the stub wall being formed with the inlet, the holder wall being formed in its lower position formed in its upper position with a forwardly disposed downwardly projecting holder flange;

and further including a holder, a concentrate inlet, and a dilutant inlet;

a cartridge for receiving a concentrate, configured to be received in the holder and including an outlet for, upon mounting in the holder, being disposed in fluid communication with the inlet to form a concentrate flow passage, the cartridge is formed with back and bottom walls, the back wall being configured with an upwardly facing groove for releasably receiving the holder flange, the bottom wall being formed with downwardly facing shoulders spaced a selected distance from the bottom wall and further being formed with a downwardly projecting neck defining the outlet; and;

a transfer device for transferring concentrate from the cartridge, through the flow passage to the applicator container, the transfer device including a valve housing to be received slidably on deck, interposed between the deck and shoulders and having a height sufficient to, when on the deck and the cartridge disposed thereover, maintain the groove releasably engaged with the holder flange.

2. The combined applicator container and concentrate cartridge device of claim 1 wherein:

the container is formed with a front wall configured with a holder recess therein defining in its bottom portion a horizontally projecting deck wall and being turned upwardly there behind to form a back stub wall configured with the inlet, the front wall projecting upwardly from the stub wall to form a dock back wall;

the transfer device includes a valve housing configured to be slidably received on the deck, including a top wall defining an upwardly opening well with access opening leading from the well to a poppet passage leading to a rearwardly projecting transfer tube to be, when the housing is on the deck, releasably received in sealing engagement with the inlet;

a valve poppet received in the poppet passage and shiftable from a closed position blocking the passage against flow from the well to the rearwardly projecting tube to an open position providing a pathway for flow from the well to the tube; and the cartridge is formed with an outlet neck to be, when the cartridge is in the dock, received in the well to be engaged in fluid flow relationship with the access opening.

3. The combined applicator container and concentrate cartridge device of claim 2 wherein:

the container wall is formed on opposite sides of the deck with upwardly opening detents; and the valve housing is formed on its opposite sides with downwardly projecting ears to be, when the valve housing is positioned on the deck, releasably engaged with respective detents.

4. The combined applicator container and concentrate cartridge device of claim 2 wherein:

the valve housing is formed with an access tube projecting upwardly in the well; and the cartridge includes a closure configured over the neck to be, as the neck is positioned in the well, penetrated by the access tube.

5. The combined applicator container and concentrate cartridge device of claim 1 wherein:

the holder wall is formed in its lower position with a downwardly projecting catch rib disposed a selected distance above the deck; and the valve housing is formed in its top wall with a upwardly opening catch groove for releasably receiving the catch rib when the valve housing is installed on the deck.

6. The combined applicator container and concentrate cartridge device of claim 1 wherein:

the valve housing is formed with a rearwardly projecting transfer tube configured to be, when the valve is on the deck received within the inlet and the device further includes;

a sealing grommet in the inlet to sealingly surrounding the tube.

7. The combined applicator container and concentrate cartridge device of claim 2 wherein:

the valve poppet includes a biasing device biasing the actuator to a selected position.

* * * * *

UNITED STATES PATENT AND TRADEMARK OFFICE

CERTIFICATE OF CORRECTION

PATENT NO. : 7,926,682 B2
APPLICATION NO. : 11/788536
DATED : April 19, 2011
INVENTOR(S) : Steven D. Nelson et al.

It is certified that error appears in the above-identified patent and that said Letters Patent is hereby corrected as shown below:

IN THE CLAIMS:

Column 12, claim 1, line 39, between “its” and “upper” delete “lower position formed in its”.
Column 12, claim 1, line 40, between “disposed” and “downwardly” insert --,--.

Signed and Sealed this
Eleventh Day of September, 2012

David J. Kappos

David J. Kappos
*Director of the United States Patent and Trademark Office*